US006779536B2

(12) United States Patent
Kuo

(10) Patent No.: US 6,779,536 B2
(45) Date of Patent: Aug. 24, 2004

(54) PROTECTING STRUCTURE FOR A BUTTON OF AN AUTO-UMBRELLA

(76) Inventor: Shih-Shin Kuo, 8F, No. 39, Sau Nien Street, Hsinchu (TW)

( * ) Notice: Subject to any disclaimer, the term of this patent is extended or adjusted under 35 U.S.C. 154(b) by 56 days.

(21) Appl. No.: 10/216,175

(22) Filed: Aug. 12, 2002

(65) Prior Publication Data

US 2004/0025914 A1 Feb. 12, 2004

(51) Int. Cl.[7] ..... A45B 25/14
(52) U.S. Cl. ..... 135/24; 135/25.4
(58) Field of Search ..... 135/15.1, 20.3, 135/22, 24, 25.4, 25.41, 72, 76; 403/348, 349, 377

(56) References Cited

U.S. PATENT DOCUMENTS 5,186,197 A * 2/1993 Lavine ..... 135/25.4
5,458,144 A * 10/1995 Lavine ..... 135/24

FOREIGN PATENT DOCUMENTS

WO WO 87/03460 * 6/1987

* cited by examiner

*Primary Examiner*—James O. Hansen
(74) *Attorney, Agent, or Firm*—Rosenberg, Klein & Lee

(57) ABSTRACT

A protective structure for a button of an auto umbrella includes a shell slidably mounted on a handle. The handle, connected to the lower end of the umbrella shaft, has a control apparatus inside for automatically opening or closing the umbrella. A button of the control apparatus that is provided on the handle can be protectively covered under the shell and thereby obviate the problem of inadvertently hitting the button and causing unwanted opening or closing of the umbrella.

3 Claims, 3 Drawing Sheets

PROTECTING STRUCTURE FOR A BUTTON OF AN AUTO-UMBRELLA

BACKGROUND OF THE INVENTION

A conventional auto-umbrella is an umbrella able to be opened and/or closed automatically. It is usually provided with a button on the umbrella handle to permit a user to effectuate for the opening or closing of the umbrella. Since the button is exposed, it is prone to be accidentally touched, thereby causing the umbrella to be inadvertently and undesirably opened or closed.

Accordingly, the primary object of the invention is to provide a protective structure for a button of an auto-umbrella, which includes a shell provided on the handle to cover the button thereby guarding against inadvertent opening or closing due to the button being touched accidentally. The features and advantages of the present invention will be described in detail now, with reference to the accompanying drawings.

BRIEF DESCRIPTION OF ACCOMPANYING DRAWINGS

DETAILED DESCRIPTION OF PREFERRED EMBODIMENTS

Figure 1:
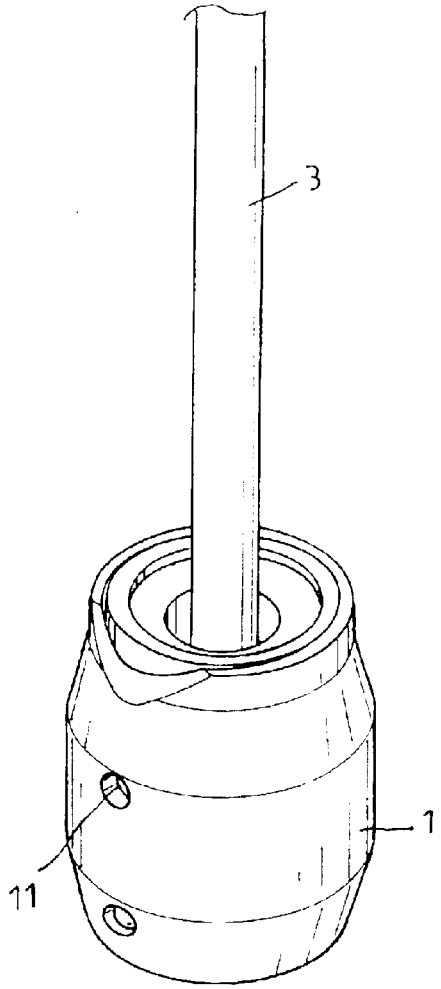
FIG. 1 is a perspective view showing an auto-umbrella with a protecting structure according to the present invention.
Figure 2:
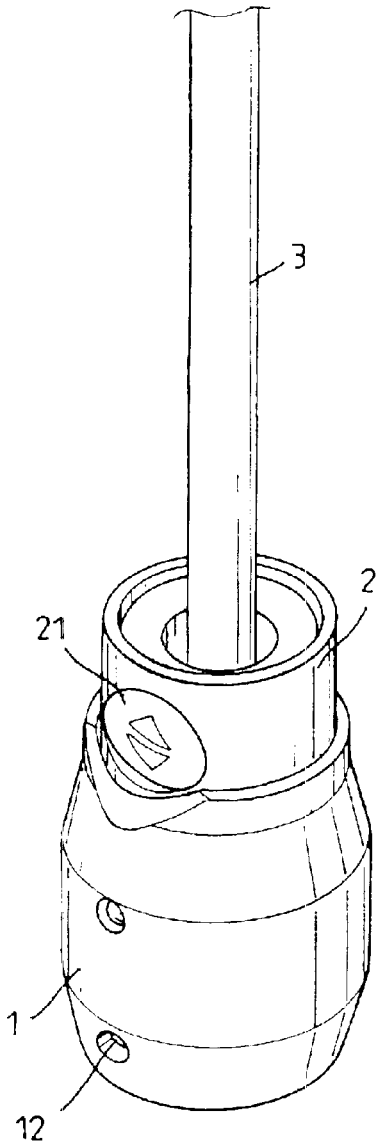
FIG. 2 is a perspective view showing a handle with a button exposed from the protecting structure of FIG. 1.
Figure 3:
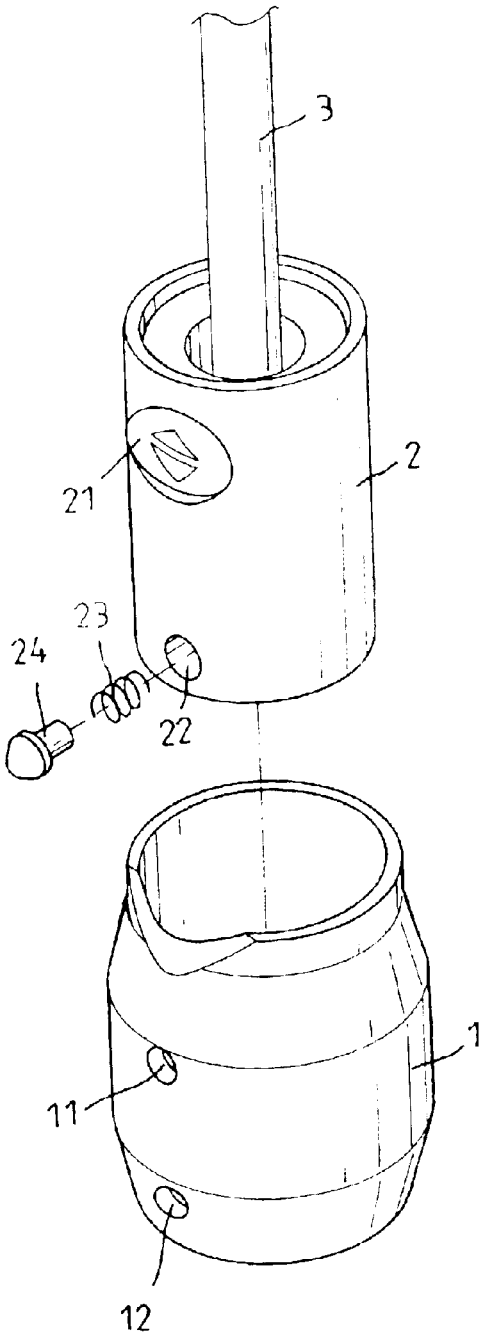
FIG. 3 is an exploded perspective view of FIG. 1.
Figure 4:
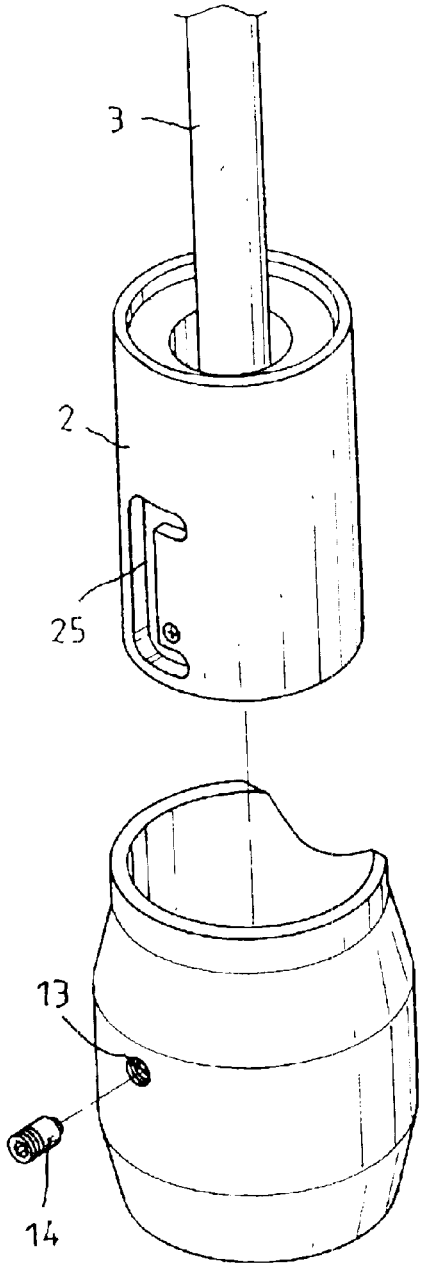
FIG. 4 is a perspective view of FIG. 3 turned 180 degrees.

With reference now to FIGS. 1 to 4, the present invention relates to an improvement of an auto-umbrella, which is provided herein with a protective structure, specifically, a shell (1). A handle (2) connects to the lower end of a shaft (3) and includes under the shell 1 a button (21) to control the opening or closing of the umbrella. The shell (1) has an upper aperture (11) and a lower aperture (12) formed in a first side therein (1), and a screw hole (13) adapted to reversibly receive a rod (14) on a second side of the shell (2). The handle (2) has formed on one side a lower groove (22) for receiving a small spring (23) and a ball (24) formed on another side is a U-shaped channel (25). Hence, when the handle (2) is positioned within the shell (1), it obtains two stable positions as the ball (24) is positioned at the place of the upper aperture (11) or the lower aperture (12) of the shell (1). Meanwhile, the inner end of the rod (14) is inserted into the space of the U-shaped channel (25) for limiting the handle (2) being movable relative to the shell (1) without separation therefrom.

Figure 8:
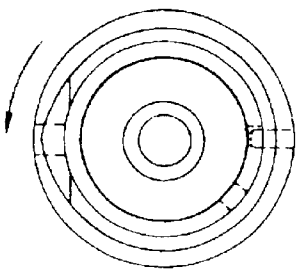
FIGS. 8 to 10 are top plan views of FIGS. 5 to 7.
Figure 5:
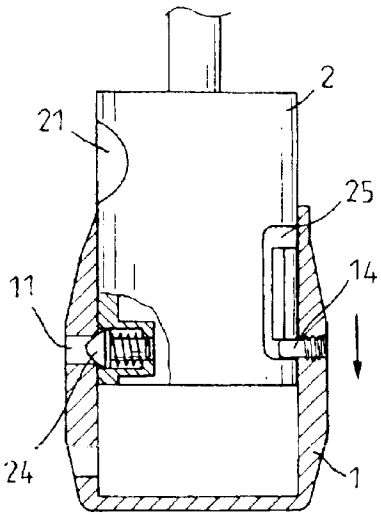
FIGS. 5 to 7 are plan views showing the handle being received in the protective structure step by step.
Figure 9:
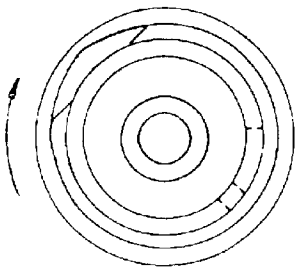
Figure 6:
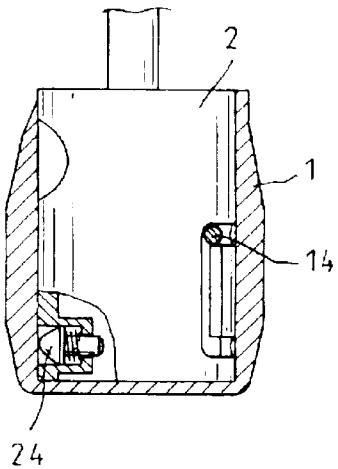
Figure 10:
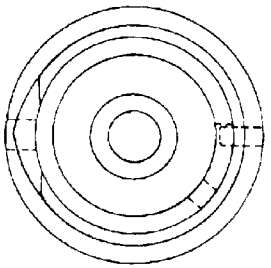
Figure 7:
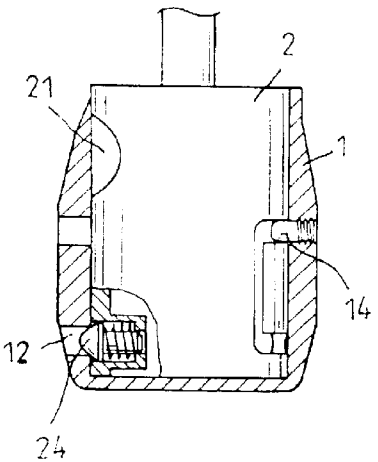

When the button (21) is exposed, the umbrella can be operated normally by pressing the button to effectuate the umbrella's opening or closing. For such normal operation, the ball (24) is positioned at the upper aperture (11) and the inner end of the rod (14) is in the lower horizontal space of the U-shaped channel (25). In order to receive the handle (2) the shell (1) is rotated relative to the handle (2), as shown in FIGS. 5 and 8. The rod (14) is moved to the lowest position of the vertical space of the U-shaped channel (25) and the ball (24) is pressed into the groove (22). Handle (2) is slidably received in the shell (1) as shown in FIGS. 6 and 9 while the inner end of the rod (14) is at the top position of the vertical space of the U-shaped channel (25). Then, the shell (1) is rotated so that the ball (24) is biased to engage with the lower aperture (12) by the small spring (23) and thereby assumes another stable positioning place, as shown in FIGS. 7 and 10. The button (21) is covered by the shell (1) and can not be accidentally touched.

Accordingly, the present invention achieves utility and improvement in a patentably innovative manner.

What is claimed is:

1. A protective structure for a button of an auto-umbrella comprising:

a shell;

a handle connecting with a lower end of a shaft and slidably received in said shell;

a button to control an opening or closing of the umbrella positioned on the handle, medial to the shell; the shell having formed in a first side an upper aperture and a lower aperture;

a screw hole formed in said shell and adapted to reversibly receive a rod;

a lower groove formed in a first side of said handle for receiving a small spring and a ball;

a U-shaped channel formed in a second side of said handle and comprising an upper horizontal space and a lower horizontal space joined by a vertical space, wherein the handle can be slidably positioned relative to said shell in either of two stable positions as the ball is biased by said small spring into either the upper aperture or the lower aperture of the shell, and an inner end of the rod is inserted into the the U-shaped channel so as to limit a movement of the handle relative to the shell without separation therefrom.

2. The protective structure for a button of an auto-umbrella as claimed in claim 1, wherein the umbrella can be operated normally by pressing the button as it is exposed by the ball being positioned at the upper aperture and the inner end of the rod being in the lower horizontal space of the U-shaped channel.

3. The protective structure for a button of an auto-umbrella as claimed in claim 1, wherein the handle is received in the shell and the button is completely hidden while by positioning both the ball at the lower aperture and the inner end of the rod in the lower horizontal space of the U-shaped channel.

* * * * *